US005924291A

United States Patent [19]

Weiler et al.

[11] Patent Number: 5,924,291

[45] Date of Patent: Jul. 20, 1999

[54] HIGH PRESSURE CRYOGENIC FLUID DELIVERY SYSTEM

[75] Inventors: James Michael Weiler, Shakopee; Thomas Karl Drube, Lakeville; Audrey Duane Preston, New Prague, all of Minn.

[73] Assignee: MVE, Inc., New Prague, Minn.

[21] Appl. No.: 08/953,963

[22] Filed: Oct. 20, 1997

[51] Int. Cl.[6] ..... F17C 9/02

[52] U.S. Cl. ..... 62/50.2; 62/48.1

[58] Field of Search ..... 62/48.1, 50.1, 62/50.2

[56] References Cited

U.S. PATENT DOCUMENTS

| | | | |
|---|---|---|---|
| 4,175,395 | 11/1979 | Prost et al. | 62/50.2 |
| 5,107,906 | 4/1992 | Swenson et al. | 62/50.2 X |
| 5,121,609 | 6/1992 | Cielukowski . | |
| 5,127,230 | 7/1992 | Neeser et al. | 62/50.2 X |
| 5,231,838 | 8/1993 | Cieslukowski . | |
| 5,373,702 | 12/1994 | Kalet et al. | 62/50.2 |
| 5,409,046 | 4/1995 | Swenson et al. | 62/50.2 X |
| 5,421,160 | 6/1995 | Gustafson et al. . | |
| 5,421,162 | 6/1995 | Gustafson et al. . | |
| 5,520,000 | 5/1996 | Pevzner | 62/48.1 |
| 5,537,824 | 7/1996 | Gustafson et al. | 62/50.2 X |
| 5,687,776 | 11/1997 | Forgash et al. | 62/50.2 X |

FOREIGN PATENT DOCUMENTS

| | | |
|---|---|---|
| WO 96/356078 | 11/1996 | WIPO . |

*Primary Examiner*—Christopher B. Kilner
*Attorney, Agent, or Firm*—Rudnick & Wolfe

[57] ABSTRACT

A system delivers cryogenic gas at a high pressure from a supply of cryogenic liquid maintained at a low pressure in a bulk tank. The bulk tank supplies liquid to at least one transfer tank. The transfer tank is pressurized by connecting it to a pressure building tank contaning gas at a high pressure. A heat exchanger is connected in circuit between the transfer tank and the pressure building tank. The transfer tank provides liquid at a high pressure to the heat exchanger so that a vapor is produced. This vapor is fed to the pressure building tank so that the high pressure therein is maintained. The transfer tank provides a high pressure flow of liquid to a vaporizer and a high pressure gas storage tank so that high pressure cryogenic gas may be produced and stored.

20 Claims, 7 Drawing Sheets

HIGH PRESSURE VAPORIZER
TO USER
PS
HIGH PRESSURE GAS STORAGE
P.B. GAS TANK
TRANSFER TANK
TRANSFER TANK
BULK TANK
LOW PRESSURE
PT
LLG
PT
LLG
MICRO COMPUTER
P.B. COIL
MM
10
12
14
16
18
22
24
26
30
34
36
40
42
44
46
50
52
54
56
58
61
62
64
66
74
76
78
82
84
88
90

HIGH PRESSURE CRYOGENIC FLUID DELIVERY SYSTEM

BACKGROUND

The present invention generally relates to delivery systems for cryogenic fluids and, more particularly, to a delivery system that supplies high pressure cryogenic fluids from a low pressure cryogenic liquid container without the use of pumps or compressors.

Cryogenic liquids, that is, liquids having a boiling point generally below −150° F. at atmospheric pressure, are used in a variety of applications. Many of these applications require that the cryogen be supplied as a high pressure gas. For example, high pressure nitrogen and argon gases are required for laser welding and metal powder production while high pressure nitrogen, oxygen and argon gases are required for laser cutting.

These cryogens are stored as liquids, however, because one volume of liquid produces many volumes of gas (600–900 volumes of gas per one volume of liquid) when the liquid is allowed to vaporize (boil) and warm to ambient temperature. To store an equivalent amount of gas requires that the gas be stored at a very high pressure. This requires a container that is larger and much heavier than if the cryogen is stored as a liquid. It also normally requires expensive, high maintenance compressors or pumps to increase the pressure to the required high level. Examples of other cryogens stored and transported as liquids, but used as gases, include hydrogen, helium and liquified natural gas (mostly methane). Carbon dioxide is not generally recognized as a cryogen, but is also stored as a cold liquid in highly insulated containers and used as a gas.

Many cryogenic products of the type mentioned above are used in applications requiring fluids at pressures between 100 psi and 400 psi. Existing systems, such as the VCS system manufactured by MVE, Inc., utilize a bulk cryogenic storage tank with an operating pressure equivalent to the pressure required by the application. The pressure within the storage tank is increased with a conventional pressure building system. More specifically, cryogenic liquid from within the storage tank is fed to a heat exchanger where it is heated by the ambient air. The vapor thereby created is returned to the top of the storage tank so that the pressure within the tank is increased. The tank and its contents are at a higher elevation than the pressure building heat exchanger so that the cryogenic liquid is gravity fed to the latter through a regulating valve. When the desired pressure is reached within the bulk storage tank, the regulating valve is closed thus stopping the flow of cryogenic liquid to the heat exchanger. Cryogenic liquid from within the bulk tank is then delivered to the application at the desired pressure to be used as liquid, or is vaporized in another heat exchanger if gas is required.

While this type of system works well, cryogenic storage tanks that are able to hold pressures over 250 psi are expensive when compared to lower pressure cryogenic tanks. Furthermore, such systems are limited to providing cryogenic fluids at a pressure of 400 psi or less. This is because the delivery systems (that are on a transport such as a truck or railroad car) that refill the bulk cryogenic storage tank feature pumps that cannot deliver product to a bulk storage tank that is at a pressure greater than 400 psi. As a result, if the pressure in the bulk cryogenic storage tank is increased to a level above 400 psi, it must be vented prior to being refilled. Such venting is wasteful and may be unsafe or detrimental to the environment.

Accordingly, an object of the invention is to provide a cryogenic delivery system that can utilize existing low pressure cryogenic storage containers while supplying cryogenic fluids at higher pressures. Another object of the invention is to provide a high pressure cryogenic delivery system that does not require venting.

U.S. Pat. Nos. 5,421,160 and 5,537,824 to Gustafson disclose fueling systems for natural gas powered vehicles that use a bulk cryogenic storage container for storing a large quantity of liquid natural gas (LNG) at a low pressure. The LNG is delivered to two relatively small volume fuel transfer tanks wherein the pressure and temperature of the LNG may be raised or lowered as dictated by the needs of the application. This is accomplished by delivering high pressure natural gas vapor to the fuel transfer tanks from a high pressure bank consisting of one or more heat exchangers, a compressor and a number of small volume, high pressure storage tanks. LNG flows from the bulk container to the heat exchanger of the bank where it is vaporized. The vapor thus produced is compressed by the compressor to a high pressure and is then stored in the small high pressure tanks. The compressor may also be used to reduce undesirable pressure buildup in the bulk container by removing vapor from its head space. This avoids the need for venting the bulk tank.

While this system also works well, it requires the use of high pressure compressors or pumps to produce the high pressure gas and to control the pressure in the bulk tank. Such compressors and pumps are expensive to purchase and maintain. Furthermore, the use of high pressure compressors or pumps increase the power requirements of the system while decreasing its reliability. Accordingly, another object of the invention is to provide a cryogenic delivery system that can increase the pressure of cryogenic liquids and control the pressure in the bulk tank without the need for high pressure pumps or compressors.

SUMMARY

The present invention is directed to a system that dispenses cryogenic fluid at a high pressure from a supply of cryogenic liquid stored at a low pressure. The system features a low pressure bulk storage tank containing a supply of cryogenic liquid. At least one transfer tank is connected to the bulk storage tank so that it receives a portion of the cryogenic liquid. A pressure building tank containing gas at a high pressure is connected to the transfer tank so that it is pressurized.

A heat exchanger is connected in circuit between the transfer tank and pressure building tank. The heat exchanger receives a supply of cryogenic liquid from the transfer tank so that a vapor is produced. This vapor is routed to the pressure building tank so that the pressure therein is maintained. In this respect, the system acts as a "self-sustaining continuous operation machine." That is, the system uses the pressure building tank to pressurize the transfer tank which, in turn, feeds the heat exchanger to pressurize the pressure building tank. As a result, the high pressure is "saved" in the pressure building tank so that the pressure does not have to be built up again for the next cycle.

Cryogenic liquid from the pressurized transfer tank may be dispensed to a vaporizer where a cryogenic gas is produced. The gas is fed from the vaporizer to a high pressure storage tank for storage and use by the application.

For a more complete understanding of the nature and scope of the invention, reference may now be had to the following detailed description of embodiments thereof taken in conjunction with the appended claims and accompanying drawings.

DESCRIPTION

Figure 1:
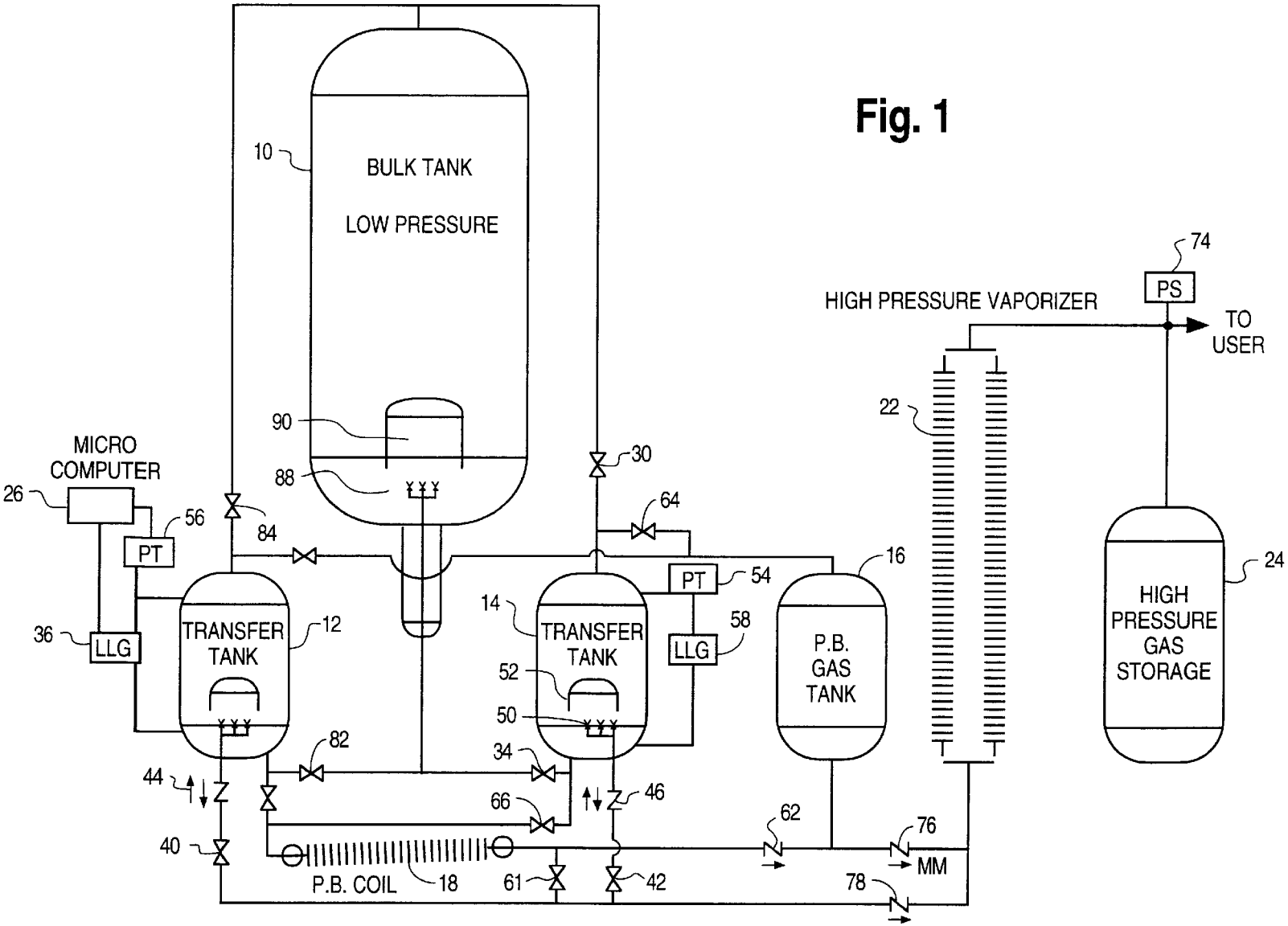
FIG. 1 is a schematic diagram of an embodiment of the high pressure cryogenic fluid delivery system of the present invention.

Referring to FIG. 1, an embodiment of the high pressure cryogenic fluid delivery system of the present invention is shown. A cryogenic liquid is stored in cryogenic bulk storage tank 10 at a low pressure, between 10 psi and its maximum allowable working pressure, typically 175 psi to 250 psi. According to the invention, however, the present system can deliver cryogens in either liquid or gaseous form at pressures up to about 1800 psi without venting product in the process or during refilling of the bulk tank 10.

Connected to bulk tank 10 are transfer tanks 12 and 14. The system is configured so that transfer tanks 12 and 14 communicate with each other or individually with bulk tank 10 as required. In addition, a pressure building tank 16 selectively communicates individually with either one of the transfer tanks 12 or 14. In circuit between pressure building tank 16 and the selected one of the transfer tanks 12 or 14 is a heat exchanger 18. Transfer tanks 12 and 14 also selectively communicate individually with high pressure vaporizer 22 from which high pressure gas is supplied to a high pressure gas storage tank 24 for use by the application. High pressure vaporizer 22 may be omitted if the application only requires high pressure cryogenic liquid. A micro computer 26 controls the opening and closing of all valves of the system, although this may also be accomplished manually, if desired.

Figure 2A:
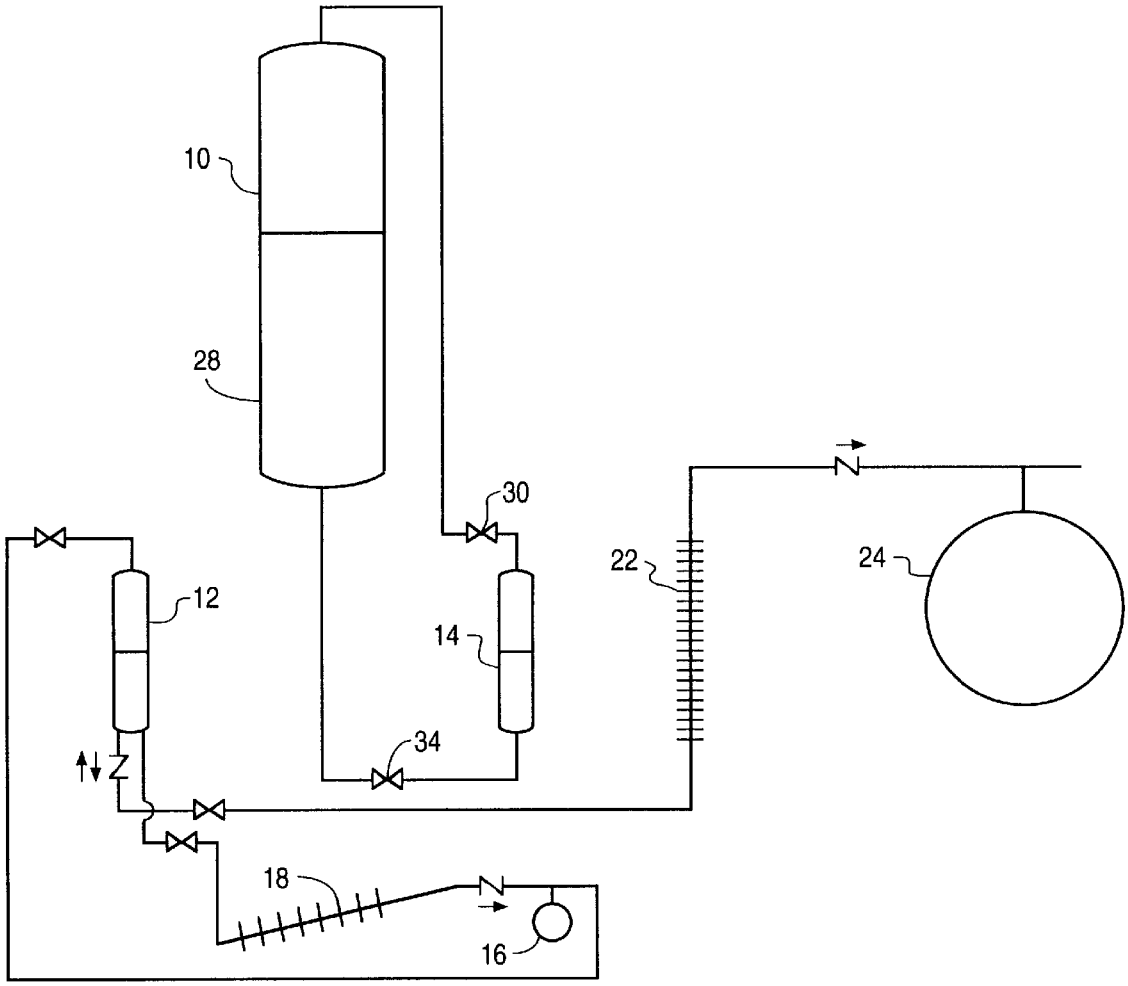
FIGS. 2A–2F are enlarged, simplified schematic diagrams of the delivery system of FIG. 1 illustrating the method of operation of the present invention.

Turning now to FIGS. 2A–2F, the operation of the system will be explained. FIG. 2A shows the system configured to supply high pressure gas to high pressure gas storage tank 24, from transfer tank 12. This will be discussed further in connection with FIG. 2F. While transfer tank 12 is being drained, transfer tank 14 is gravity fed with liquid cryogen 28 from bulk tank 10 by opening valves 30 and 34. When transfer tank 14 is filled approximately half full (as illustrated), valves 30 and 34 are closed thus stopping the flow of cryogenic liquid 28 into transfer tank 14. At this point, the pressure within transfer tank 14 is the same as that in bulk tank 10. Referring to FIG. 1, the fill is terminated by liquid level gauge/transmitter 58 sending a signal to micro computer 26.

Figure 2B:
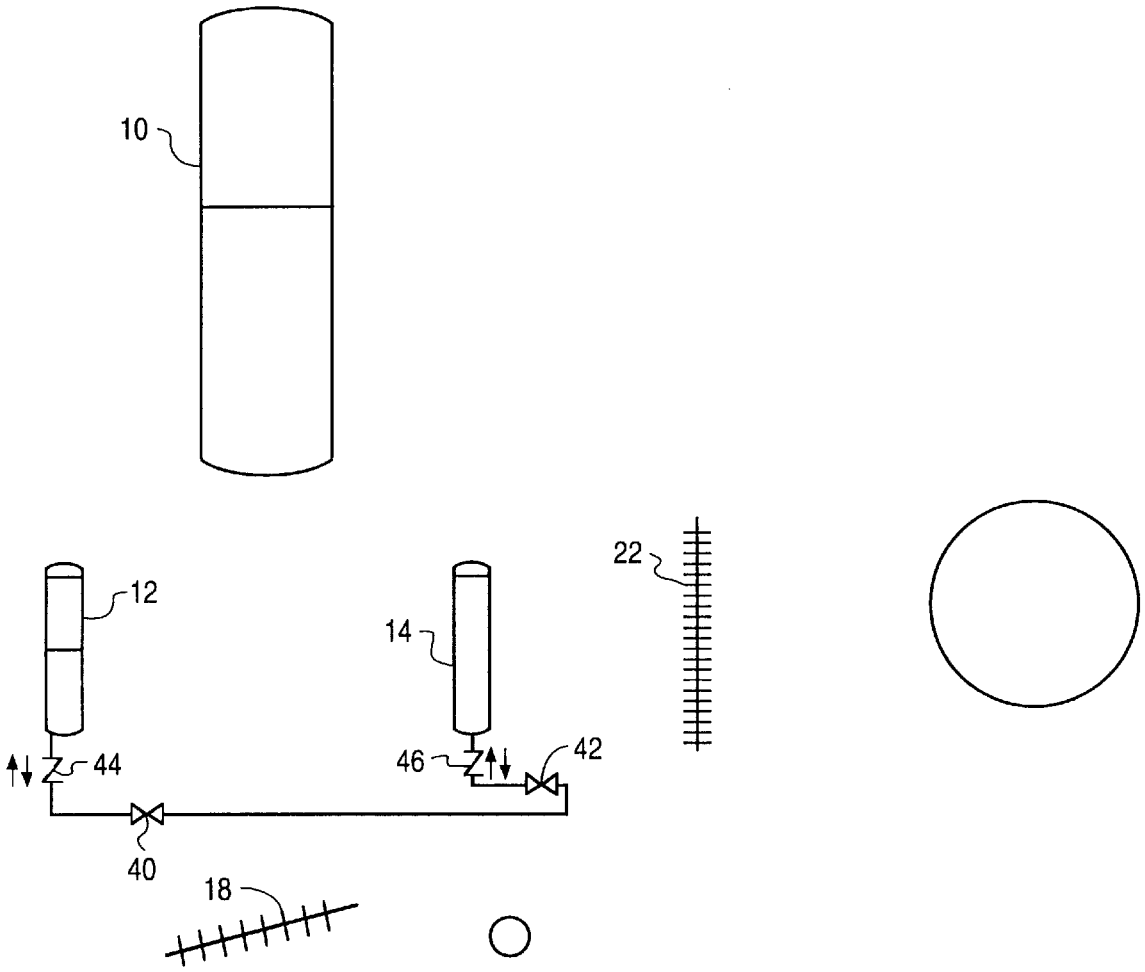

As shown in FIG. 2B, after transfer tank 12 has exhausted its supply of liquid cryogen, it is isolated from heat exchangers 18 and 22. Valves 40 and 42 are then opened so that transfer tanks 12 and 14 are in communication with one another. Having just completed its delivery cycle, transfer tank 12 contains cold gas at approximately 1200 psi, but no liquid. When valves 40 and 42 are opened, gas flows from transfer tank 12 through valves 40 and 42, and combination check-flow and control valves 44 and 46, to transfer tank 14. On reaching transfer tank 14, the gas condenses due to mixer nozzles 50 and diffuser chamber 52 (FIG. 1).

Combination check-flow and control valves 44 and 46 allow unrestricted flow out of their respective transfer tanks 12 and 14, but limit the flow into them. They are necessary because otherwise, cold gas would flow from tank 12 into tank 14 at a rate faster than mixer nozzles 50 and diffuser chamber 52 could condense it.

Transfer tanks 12 and 14 remain in communication with one another until they are at approximately the same intermediate pressure, which is about 300 psi. When this occurs, tank 14 will usually be almost full due to the condensation of the high pressure cold gas from transfer tank 12. Referring to FIG. 1, micro computer 26 causes valves 40 and 42 to close when either the pressure in transfer tank 14 rises to within 5 psi of the pressure within transfer tank 12, as signaled from pressure transmitters 54 and 56, or when liquid level gauge/transmitter 58 signals that transfer tank 14 is approximately 95% full.

Figure 2C:
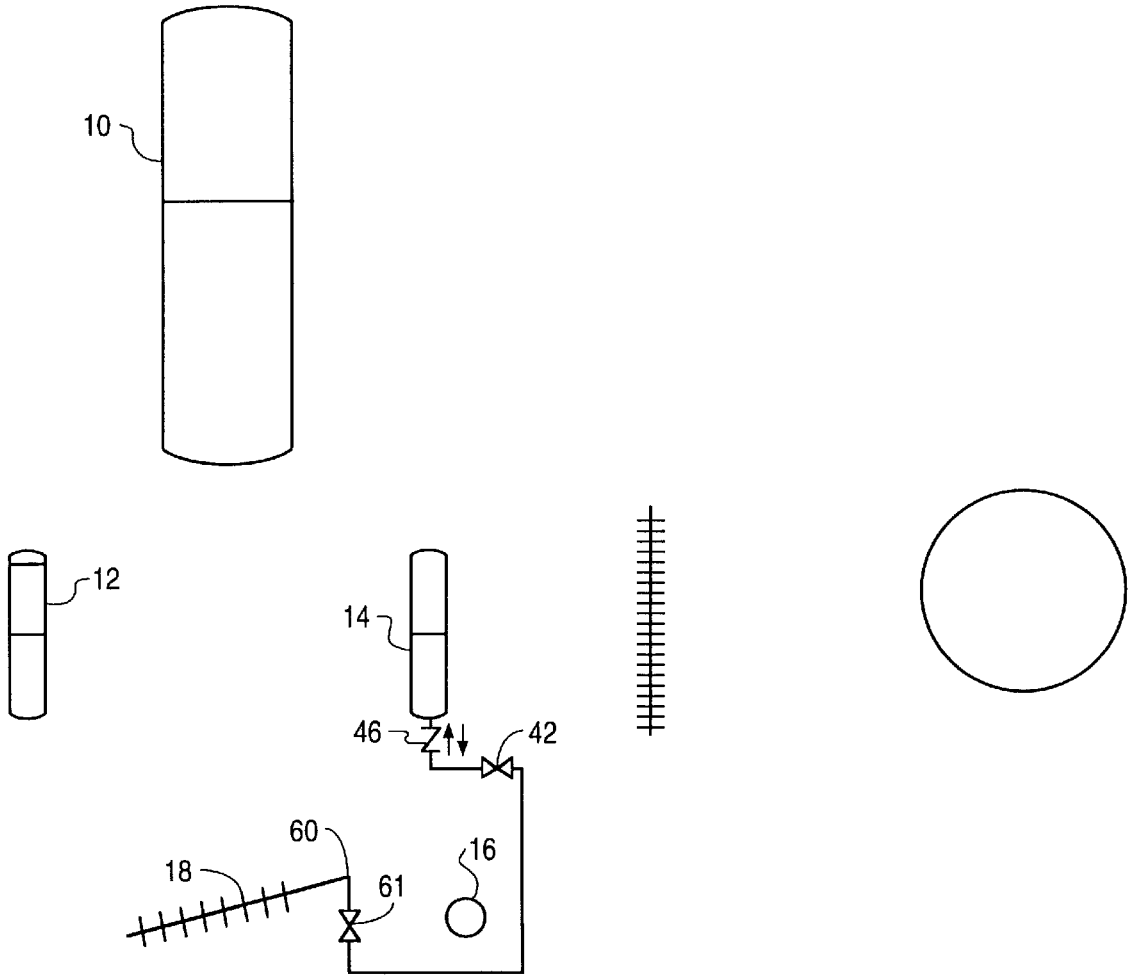

Next, as shown in FIG. 2C, transfer tank 14 is isolated from tank 12 and connected to the gas side 60 of pressure building heat exchanger 18 by opening valves 42 and 61 for 15–30 seconds. Pressure building heat exchanger 18 is maintained at 1200–1300 psi. When valve 42 is opened, the gas in heat exchanger 18 flows into the transfer tank 14 raising the pressure therein. This is done to lower the pressure in heat exchanger 18 so that it may be force fed cold liquid cryogen in the next step. As will be discussed below, this promotes the almost continuous and rapid pressure building necessary to support a high volume, high pressure system.

Figure 2D:
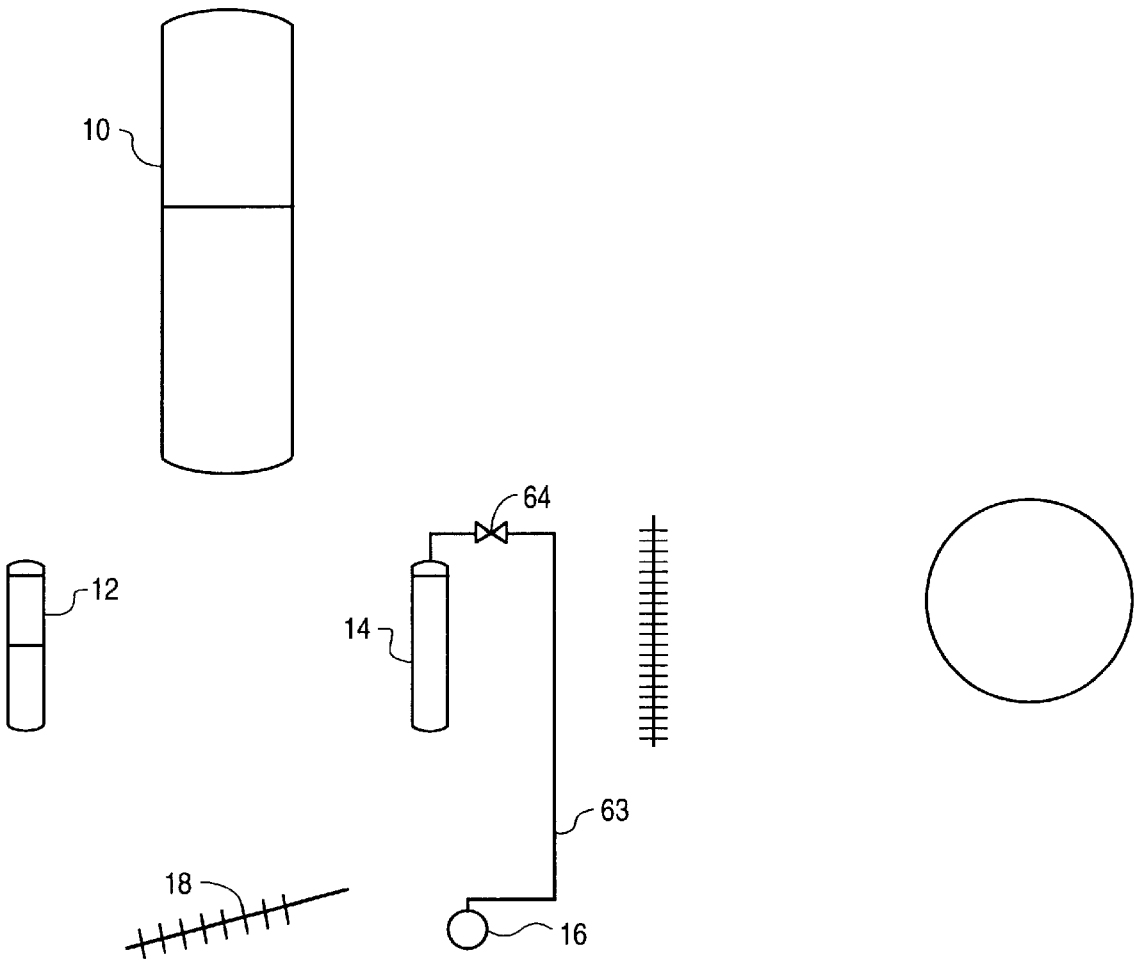
Figure 2E:
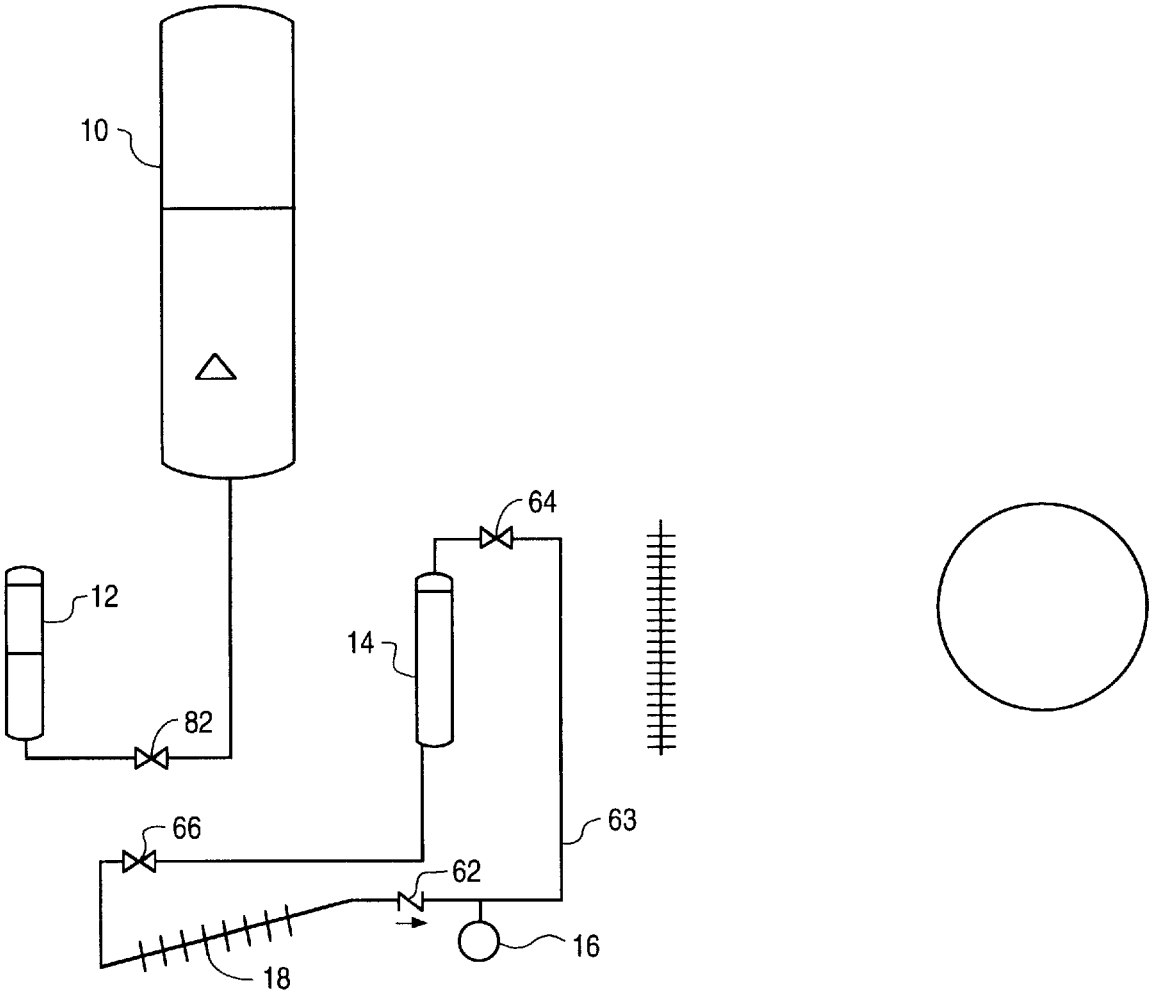

After transfer tank 14 is disconnected from pressure building heat exchanger 18, the tank is placed in communication with pressure building tank 16, which has relatively high pressure gas (1200–1300 psi) therein, via line 63 by opening valve 64 (FIG. 2D). As a result, transfer tank 14 is rapidly pressurized to a delivery pressure of 1200–1300 psi. Shortly thereafter, as shown in FIG. 2E, valve 66 is opened so that heat exchanger 18 is charged with cryogenic liquid from transfer tank 14. This is done so that the high pressure in tank 16 is maintained. Due to the increased pressure in transfer tank 14, and the lower pressure of heat exchanger 18 (due to it being discharged, as described in connection with FIG. 2C), liquid enters heat exchanger 18 quickly and forcefully and is rapidly vaporized. This allows pressure building tank 16 to be pressurized at a rate sufficient to maintain the high volume and pressure requirements of the system. The system of the present invention thus functions as a "self-sustaining continuous operation machine" in that transfer tank 14, charged by the pressure from pressure building tank 16, feeds cryogen to heat exchanger 18, which in turn recharges pressure building tank 16.

Figure 2F:
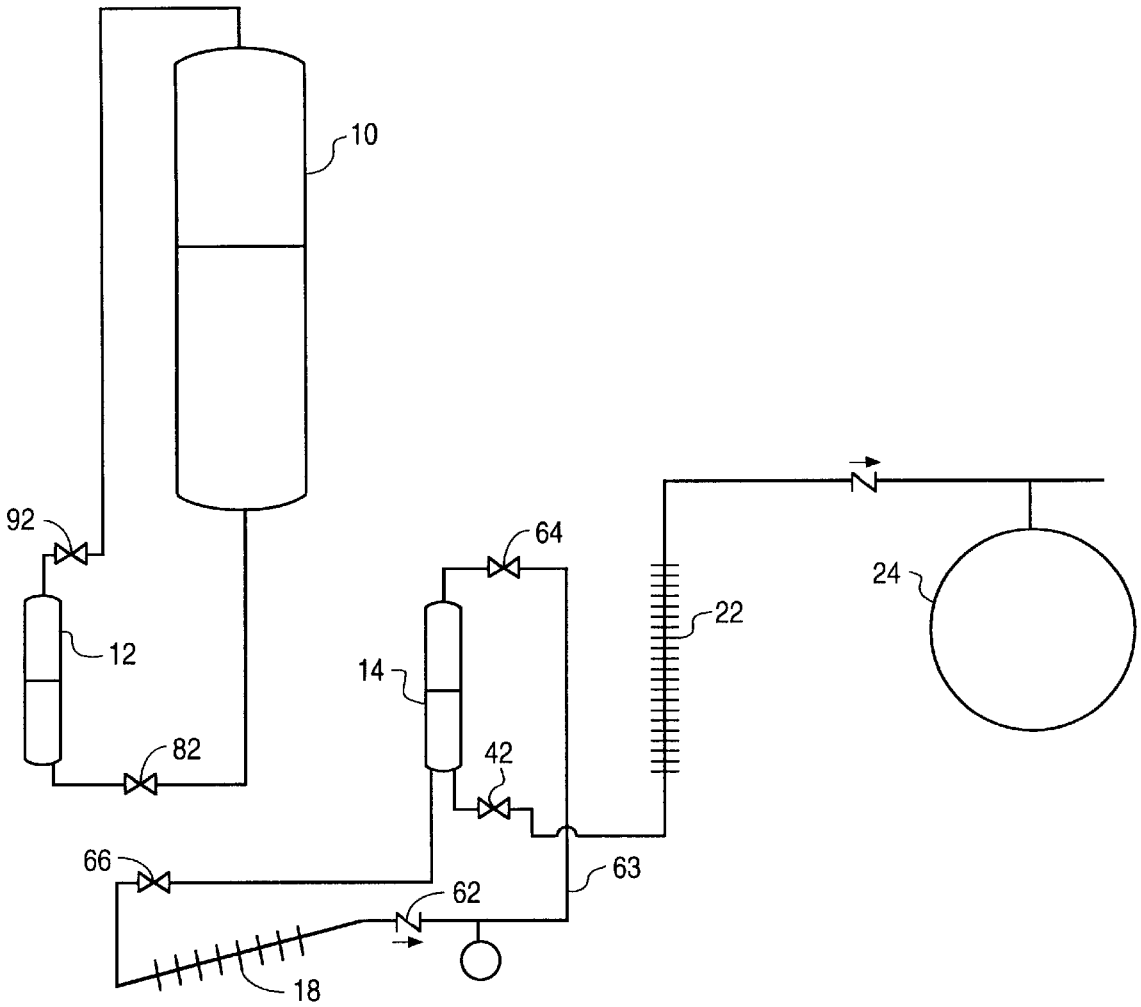

Referring to FIG. 2F, once the cryogenic liquid within transfer tank 14 has been pressurized, valve 42 is opened. This begins the delivery of liquid to high pressure vaporizer 22 which in turn delivers high pressure, near ambient temperature gas to high pressure gas storage tank 24 to be used by the customer/application as needed. As noted previously, high pressure vaporizer 22 may be omitted if the application requires high pressure cryogenic liquid instead of gas.

Referring again to FIG. 1, pressure switch 74 is connected to micro computer 26 so that the fluid delivery system is started or stopped based upon the pressure within high pressure gas storage tank 24. More specifically, switch 74 will signal the system to supply fluid when the pressure within high pressure gas storage tank 24 drops below the level required by the application. In addition, switch 74 will signal the system to stop the delivery of fluid when the pressure within high pressure gas storage tank 24 reaches a predetermined value. In order to prevent pressure within the system from exceeding a safe level, pressure regulating valve 76 is set at about 100 psi above the maximum pressure for switch 74. As a result, when the pressure within the system rises to a level above a predetermined value, pressure regulating valve 76 will release cryogen to high pressure vaporizer 22 which will in turn increase the pressure within high pressure gas storage tank 24 so that switch 74 will signal the system to shut down. Check valve 78 prevents backflow from high pressure gas storage tank 24 during those times when part of the fluid delivery system is at a lower pressure.

Referring back to FIG. 2E, while transfer tank 14 is in communication with pressure building tank 16, transfer tank 12 is equalized in pressure with bulk tank 10 by opening valve 82. As shown in FIG. 1, this allows the approximately 300 psi cold gas remaining in transfer tank 12 to flow into bulk tank 10 through mixer nozzles 88 and diffuser chamber 90. The diffusing of the gas into the much colder liquid causes the gas to liquify within bulk tank 10. This adds heat to the liquid thus slightly raising the pressure within bulk tank 10. As a result, the system cyclically pressurizes bulk tank 10 in proportion to the use rate of the liquid cryogen stored therein so that the system pressure can be controlled without venting to atmosphere. Furthermore, by proportioning the pressure increase with cryogen use, it is usually not necessary to vent bulk tank 10 before refilling it. When bulk tank 10 is refilled with cold liquid from an external source such as a transport, the pressure therein is restored to a lower value providing the heat and pressure capacity necessary to permit a new series of deliveries to take place without venting.

As shown in FIG. 2F, once the pressures in bulk tank 10 and transfer tank 12 are equalized, valve 92 is opened (while valve 82 remains open). Because the level of the liquid in bulk tank 10 is above that of the transfer tank 12, the liquid begins to flow into the latter by the force of gravity. Micro computer 26 stops the fill by closing valves 82 and 92 when liquid level gauge/transmitter 36 indicates that transfer tank 12 is approximately halfway filled.

When transfer tank 14 has exhausted its supply of liquid cryogen, as signaled by liquid level gauge/transmitter 58 (FIG. 1), valves 66, 64 and 42 are closed so that transfer tank 14 is isolated from pressure building vaporizer 18 and high pressure vaporizer 22. At this point, the system repeats the steps illustrated in FIGS. 2B–2F, but for transfer tank 12. This completes the cycle of alternately filling and dispensing from the tanks 12 and 14.

All tanks and piping are provided with appropriate overpressure relief valve devices that are known in the art but not shown in the drawings for the sake of clarity. Also not shown are the insulating jackets on bulk tank 10, transfer tanks 12 and 14 and the piping sections that normally contain liquid. The foregoing description is presented to illustrate the preferred operation but is not intended to limit the scope of the invention. Applications requiring higher and lower pressures may be serviced by the system of the invention.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for pressurizing and dispensing cryogenic liquids stored at low pressure comprising:

a) a low pressure bulk storage tank (10) containing a cryogenic liquid;

b) at least one transfer tank (14) selectively communicating with said bulk storage tank (10) to receive a quantity of the cryogenic liquid therefrom;

c) a pressure building tank (16) containing a vaporized supply of said cryogenic liquid at a relatively high pressure;

d) means (64) for selectively communicating said pressure building tank (16) directly with said transfer tank (14) to pressurize said transfer tank (14) for subsequent despensing of the liquid therein through a line (100) independent of said pressure building tank (16); and e) heat exchange means (18) for selectively vaporizing a portion of the liquid cryogen in said transfer tank (14) and supplying it to the pressure building tank (16) to recharge and maintain said relatively high pressure supply of vapor.

2. The system of claim 1 further comprising:

a) a high pressure gas storage tank (24); and b) a vaporizer (22) in circuit between the high pressure gas storage tank (24) and said transfer tank (14) so that cryogenic liquid dispensed from the transfer tank (14) is vaporized and thereafter stored in said high pressure gas storage tank (24).

3. The system of claim 1 further comprising a vaporizer (22) connected to the transfer tank (14) so that cryogenic liquid dispensed from the transfer tank (14) may be converted to high pressure gas.

4. The system of claim 1 further comprising means (42, 61) for temporarily connecting said heat exchanger means (18) to said transfer tank (14) so that the heat exchanger means (18) is thereby depressurized.

5. The system of claim 1 further comprising means (34, 88, 90) for temporarily connecting said transfer tank (14) to said bulk storage tank (10) so that system pressure may be controlled without venting to atmosphere.

6. A system for pressurizing and dispensing cryogenic fluids to an application comprising:

a) a bulk storage tank (10) containing a cryogenic liquid at a low pressure;

b) a transfer tank (14) selectively communicating with the bulk storage tank (10) so that the cryogenic liquid may flow into the transfer tank (14);

c) a pressure building tank (16) containing a supply of vaporized cryogenic liquid at a relatively high pressure at least as great as a delivery pressure, said pressure building tank (16) selectively communicating directly with the transfer tank (14) to pressurize said transfer tank (14) to the delivery pressure; and d) a heat exchanger (18) selectively in circuit between the transfer tank (14) and the pressure building tank (16) to vaporize a portion of the cryogenic liquid from the transfer tank (14) to recharge and maintain said relatively high pressure within said pressure building tank (16).

7. The system of claim 6 further comprising:

a) a high pressure gas storage tank (24); and b) a vaporizer (22) in circuit between the high pressure gas storage tank (24) and said transfer tank (14) so that cryogenic liquid dispensed from the transfer tank (14) is vaporized and thereafter stored in said high pressure gas storage tank (24).

8. The system of claim 6 further comprising a vaporizer (22) connected to the transfer tank (14) so that cryogenic liquid dispensed from the transfer tank (14) may be converted to high pressure gas.

9. The system of claim 6 further comprising means (42, 61) for temporarily connecting said heat exchanger (18) to said transfer tank (14) so that the heat exchanger (18) is thereby depressurized.

10. The system of claim 6 wherein the transfer tank (14) is a first transfer tank and further comprising:

a) a second transfer tank (12); and b) means (40, 42) for temporarily connecting said first transfer tank (14) and said second transfer tank (12) so that they are nearly equalized in terms of internal pressure.

11. The system of claim 6 further comprising means (34, 88, 90) for temporarily connecting said transfer tank (14) to said bulk storage tank (10) so that system pressure may be controlled without venting to atmosphere.

12. A method for pressurizing a cryogenic liquid stored in a low pressure bulk storage tank (10) comprising the steps of:

a) supplying cryogenic liquid from the bulk storage tank (10) to a transfer tank (14);

b) connecting a pressure building tank (16) directly to the transfer tank (14);

c) pressurizing the transfer tank (14) to a delivery pressure with high pressure gas stored in the pressure building tank (16);

d) periodically recharging the pressure building tank (16) with high pressure gas, and e) dispensing cryogenic liquid from the transfer tank (14) through a line (100) independent of the pressure building tank (16).

13. The method of claim 12 further comprising the step of charging a heat exchanger (18) with a portion of the cryogenic liquid in the transfer tank (14) so that a high pressure gas is produced, said high pressure gas used to periodically recharge the pressure building tank (16).

14. The method of claim 12 further comprising the step of dispensing the pressurized cryogenic liquid from the transfer tank (14) to a vaporizer (22) so that a cryogenic gas at the delivery pressure is produced.

15. The method of claim 14 further comprising the step of storing said cryogenic gas at the delivery pressure in a high pressure gas storage tank (24).

16. The method of claim 12 further comprising the step of temporarily connecting the transfer tank (14) to the bulk storage tank (10) so that system pressure may be controlled without venting to atmosphere.

17. A method for producing cryogenic gas at a delivery pressure from a cryogenic liquid stored in a low pressure bulk storage tank (10) comprising the steps of:

a) supplying cryogenic liquid from the bulk storage tank (10) to a transfer tank (14);

b) connecting a pressure building tank (16) directly to the transfer tank (14);

c) pressurizing the transfer tank (14) to the delivery pressure with gas stored at a pressure at least as great as the delivery pressure in a pressure building tank (16); and d) dispensing the pressurized cryogenic liquid from the transfer tank (14) to a vaporizer (22) so that a cryogenic gas at the delivery pressure is produced.

18. The method of claim 17 further comprising the step of charging a heat exchanger (18) with a portion of the cryogenic liquid in the transfer tank (14) so that a high pressure gas is produced, said high pressure gas used to periodically recharge the pressure building tank (16).

19. The method of claim 17 further comprising the step of storing said cryogenic gas at the delivery pressure in a high pressure gas storage tank (24).

20. The method of claim 17 further comprising the step of temporarily connecting the transfer tank (14) to the bulk storage tank (10) so that system pressure may be controlled without venting to atmosphere.

* * * * *